US008893766B2

(12) United States Patent
Bohlen

(10) Patent No.: US 8,893,766 B2
(45) Date of Patent: Nov. 25, 2014

(54) OPERATING UNIT FOR ARCHITECTURAL COVERINGS

(75) Inventor: Jorg Bohlen, Langen (DE)

(73) Assignee: Hunter Douglas Industries B.V., Rotterdam (NL)

( * ) Notice: Subject to any disclaimer, the term of this patent is extended or adjusted under 35 U.S.C. 154(b) by 319 days.

(21) Appl. No.: 12/810,058

(22) PCT Filed: Dec. 19, 2008

(86) PCT No.: PCT/EP2008/010887

§ 371 (c)(1),
(2), (4) Date: Jul. 29, 2010

(87) PCT Pub. No.: WO2009/086898

PCT Pub. Date: Jul. 16, 2009

(65) Prior Publication Data

US 2010/0288451 A1 Nov. 18, 2010

(30) Foreign Application Priority Data

Jan. 4, 2008 (EP) ..... 08000091

(51) Int. Cl.
*A47H 1/00* (2006.01)
*E06B 9/88* (2006.01)
*E06B 9/90* (2006.01)

(52) U.S. Cl.
CPC ..... *E06B 9/88* (2013.01); *E06B 2009/905* (2013.01)
USPC ..... 160/323.1; 160/324; 160/321; 160/297

(58) Field of Classification Search
USPC ..... 160/323.1, 324, 321, 307, 291, 292, 160/298, 903; 192/223.4, 223; 74/405, 74/411.5
See application file for complete search history.

(56) References Cited

U.S. PATENT DOCUMENTS

| | | | | | |
|---|---|---|---|---|---|
| 3,059,485 | A | * | 10/1962 | Bohlman et al. | 74/89.14 |
| 5,375,643 | A | * | 12/1994 | Rude | 160/321 |
| 5,507,374 | A | * | 4/1996 | Rude | 192/223.4 |
| 5,909,791 | A | * | 6/1999 | DiStefano | 192/223.4 |
| 6,123,140 | A | * | 9/2000 | Bergamaschi | 160/316 |
| 6,158,563 | A | * | 12/2000 | Welfonder et al. | 192/223.3 |
| 6,173,825 | B1 | * | 1/2001 | Liu | 192/223.4 |
| 6,685,592 | B2 | * | 2/2004 | Fraczek et al. | 475/14 |
| 7,195,052 | B2 | * | 3/2007 | Nien et al. | 160/321 |

(Continued)

FOREIGN PATENT DOCUMENTS

| | | | |
|---|---|---|---|
| EP | 1 918 505 | A2 | 5/2008 |
| WO | WO 94/15057 | A1 | 7/1994 |
| WO | WO 2008/025494 | A1 | 3/2008 |

*Primary Examiner* — Katherine Mitchell
*Assistant Examiner* — Abe Massad
(74) *Attorney, Agent, or Firm* — Dorsey & Whitney LLP

(57) ABSTRACT

The invention relates to an operating unit (1) for architectural coverings, in particular roller blinds or shades. The unit (1) includes a stationary base member (37), a rotatable driving member (39), a rotatable driven member (29) and a brake mechanism (71, 73, and 75). The brake mechanism (71, 73, and 75) automatically arrests rotation of the driven member (29) in respect of the stationary base member (37), when not rotated by the driving member (39). The brake mechanism includes a first wrap spring (73), adapted to yield a predetermined minimum brake force, and at least one second wrap spring (75), different in size from the first wrap spring (73) and adapted to yield a supplementary brake force, which together with the predetermined minimum brake force amounts to a predetermined maximum brake force.

22 Claims, 6 Drawing Sheets

(56) References Cited

U.S. PATENT DOCUMENTS

| | | | | |
|---|---|---|---|---|
| 7,740,047 | B2 * | 6/2010 | Koop et al. | 160/323.1 |
| 8,122,932 | B2 * | 2/2012 | Cannaverde | 160/120 |
| 8,136,569 | B2 * | 3/2012 | Bohlen et al. | 160/323.1 |
| 2003/0085003 | A1 * | 5/2003 | Cheng | 160/321 |
| 2003/0178276 | A1 * | 9/2003 | Fraczek et al. | 192/3.52 |
| 2005/0247413 | A1 * | 11/2005 | Nien et al. | 160/321 |
| 2006/0108076 | A1 * | 5/2006 | Huang | 160/176.1 R |
| 2007/0084570 | A1 * | 4/2007 | Lin | 160/321 |
| 2007/0107857 | A1 * | 5/2007 | Wang | 160/321 |
| 2008/0121353 | A1 * | 5/2008 | Detmer et al. | 160/266 |
| 2008/0289777 | A1 * | 11/2008 | Costello et al. | 160/317 |
| 2012/0193042 | A1 * | 8/2012 | Koop et al. | 160/323.1 |

* cited by examiner

OPERATING UNIT FOR ARCHITECTURAL COVERINGS

CROSS-REFERENCE TO RELATED APPLICATIONS

This application is the national stage application of PCT International Application No. PCT/EP2008/010887, filed Dec. 19, 2008 and entitled "Operating Unit For Architectural Coverings", which claims priority under 35 U.S.C. §365(b) to European Patent Application No. 08000091.2 filed Jan. 4, 2008 and entitled "Operating Unit For Architectural Coverings".

The invention relates to an operating unit for architectural coverings, in particular roller blinds or shades.

Such units usually include some kind of stationary base member, a rotatable driving member, a rotatable driven member, and a brake mechanism. The brake mechanism serves to automatically arrest rotation of the driven member in respect of the stationary base member, when it is not rotated by the driving member. Such a device is typically known from U.S. Pat. No. 6,685,592 and has a brake mechanism composed of one or more wrap springs acting on a stationary drum. While it has been customary to use, subject to the required brake force, either a single wrap spring of an appropriate size, or a variable number of wrap springs each of a uniform size. The latter option has benefitted economy and stock keeping. In the case of a roller blind type window covering the required braking force in the raised position is minimal, while in the lowered position it is maximal. Hence the required number of wrap spring windings is determined by the maximum required braking force in the fully lowered position. However with the increase of the number of windings in a wrap spring also the rotational movement between its fully released and its fully engaged condition will increase too. This results in an amount of backlash between the intended position of adjustment and a position in which the blind will be retained. When a wrap spring has a relatively large number of wraps or windings, this effect can become quite noticeable for the operating person who is trying to move the roller blind to its fully raised position. It then happens that this intended fully-raised position cannot be reached. This is so, because the bottom edge of the blind material will always drop back a certain amount before the wrap spring attains its fully gripping position. Using more than a single wrap spring, each of a uniform size such as shown by U.S. Pat. No. 6,685,592, has resulted in some improvement. This is so because in the raised position one of the springs, with less than the total number of windings, will already by itself be sufficient to hold the blind in its raised position and achieve this with less backlash. Nonetheless this beneficial effect would only have been available with blinds of a size requiring the use of at least two uniform wrap springs to cope with the required braking force in their lowered position. Moreover the backlash from the different engagement angles in the raised and lowered positions were strictly determined by the available individual wrap springs. An optimal situation has seldom been available.

Accordingly it is an object of the present invention to overcome or ameliorate at least one of the disadvantages of the prior art. It is also an object of the present invention to provide alternative structures which are less cumbersome in assembly and operation and which moreover can be made relatively inexpensively. Alternatively it is an object of the invention to at least provide the public with a useful choice.

To this end an operating unit for architectural coverings, in particular roller blinds or shades, in accordance with the invention includes a stationary base member, a rotatable driving member, a rotatable driven member and a brake mechanism for automatically arresting rotation of the driven member in respect of the stationary base member, when not rotated by the driving member, wherein the brake mechanism includes a first wrap spring, adapted to yield a predetermined minimum brake force, and at least one second wrap spring, different in size from the first wrap spring and adapted to yield a supplementary brake force, which together with the predetermined minimum brake force amounts to a predetermined maximum brake force. The improvement has enabled to substantially eliminate any objectionable backlash in the raised position of roller blinds. The amount of backlash in the lowered position is generally perceived as a less annoying phenomenon, because one can chose the amount of lowering in anticipation of the backlash.

According to a further aspect of the invention the operating unit can include a planetary gearing between the driving member and the driven member. When using such planetary gearing it can be further advantageous when the planetary gearing has a satellite carrier adapted to rotate the driven member via the brake mechanism. In combination with a planetary gearing an advantageous alternative may further have a sun gear that is rotated by the driving member, for driving a plurality of satellite pinions on the satellite carrier, and a ring gear that is kept stationary by the stationary base member. The use of such planetary gear transmissions allows the operating unit also to be used on heavy duty roller blinds that are often required in utility buildings, such as offices, hospitals and hotels.

According to another aspect the operating unit according to the invention the stationary base member is provided with a non-rotatable shaft. Such a non-rotatable shaft can be formed as a splined shaft, so as to receive a wrap spring drum. Such an arrangement makes the operating unit more versatile in that differently sized wrap spring drums and wrap springs can be fitted if desired.

According to a still further aspect of the operating unit according to the invention, bearings can be provided between the driving member and the stationary base member, between the driven member and the driving member, and between the driven member and the stationary member. In this regard it can be advantageous if one of the bearings is a thrust bearing and optionally is a ball bearing. Being able to fit separate bearings of wear resistant materials, or of friction reducing construction, will greatly enhance durability and reliability of such operating units.

In a further advantageous embodiment of the operating unit according to the invention, the driving member can be a ball chain pulley that is engaged by a looped ball chain that drivingly engages a part of its perimeter. The stationary member can then also have a guide plate to guide the ball chain and to minimise wear between the ball chain and the stationary base member. Apart from electric motors, ball chain drives offer a very attractive and cost effective alternative manual form of operation.

Further the operating unit according to the invention can also include a blind roller tube. Thereby the driven member and the roller blind tube can be provided with complementary engaging formations to drivingly connect the blind roller tube to the driven element. This arrangement will greatly enhance the assembly of roller blinds.

The operating unit according to the invention can further include a mounting bracket. The mounting bracket can thereby have a first flange and a receiving collar thereon for disconnectedly connecting to the stationary base member. It is further advantageous when the mounting collar is provided with a plurality of radial recesses and when the stationary base member is provided with an end plate with a corresponding plurality of radial projections. In such an arrangement the mounting collar and the end plate can be made relatively movable from a first position in which the projections can be inserted and released from the recesses into a second position in which the projections are engaged behind uninterrupted portions of the receiving collar that extend between successive radial recesses. The arrangement can be further improved if the receiving collar has a latch formation for locking the end plate and the receiving collar in the second position. For maintenance or window cleaning it is usually important that window coverings can be readily removed and reinstalled. For reasons of safety it is beneficial if this can be accomplished with the proposed arrangement.

An embodiment of the invention will now be explained in reference to the accompanying drawings, in which.

Figure 1:
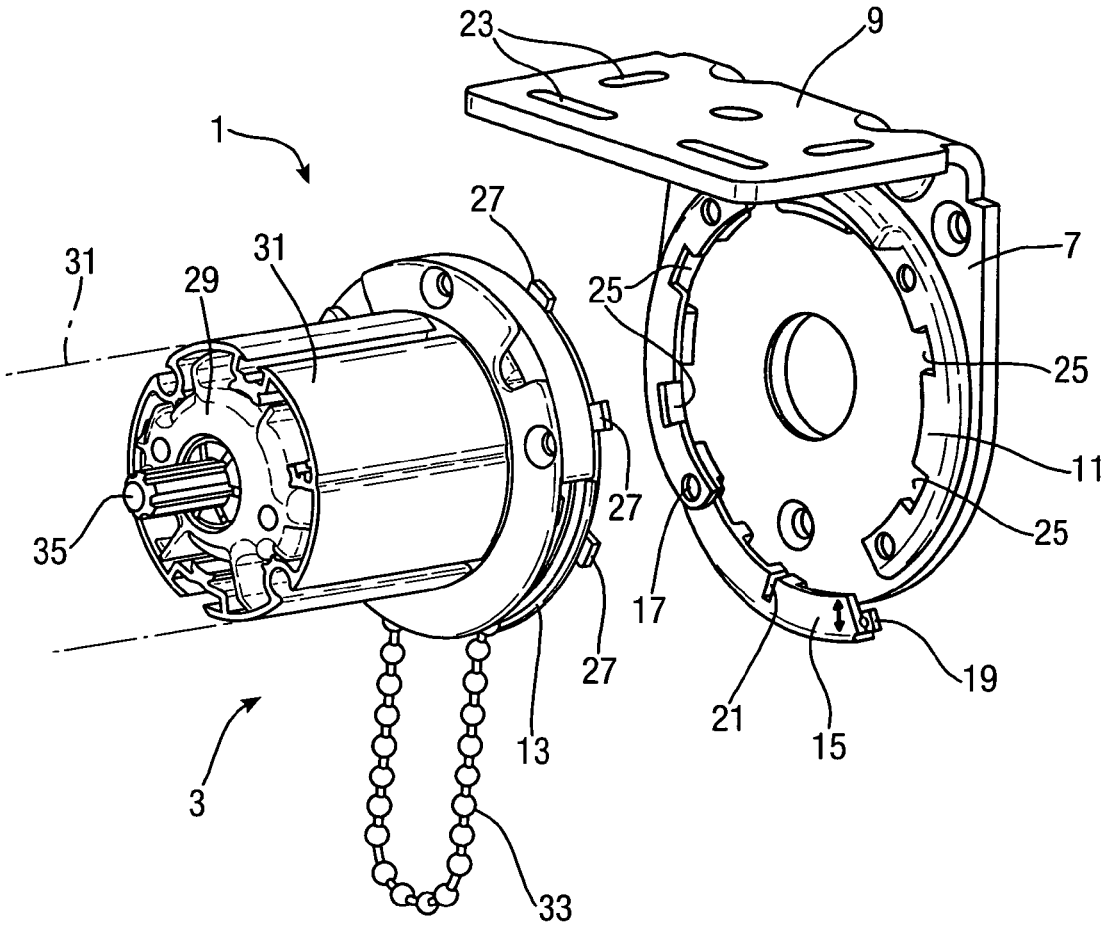
FIG. 1 is a partly exploded view of an operating unit in accordance with the invention.

Shown in FIG. 1 is a preferred embodiment of an operating unit according to the invention, in the form of a driving and mounting system 1 for architectural coverings. The system 1 generally includes a drive means 3 which is removably attachable to a mounting bracket 5.

The mounting bracket 5 comprises a first flange 7 and a second flange 9, generally perpendicular to the first flange 7. The first flange 7 has a receiving collar 11 for engaging a first stationary axial end 13 of the drive means 3. The receiving collar 11 further has a swivelling latch portion 15, which can swivel around a pivot 17 and which has a latch formation 19 to latch with the receiving collar 11. The latch portion is of a generally flexible and resilient material and may optionally be provided with a central slit 21 to increase its flexibility. The second flange 9 of the mounting bracket 5 is provided with suitable apertures such as 23 for fixation to a supporting surface or the like as is conventional. The receiving collar 11 has a number of radial recesses 25 corresponding to radial projections 27 on the first axial end 13 of the drive means 3. The radial recesses 25 on the receiving collar 11 and the radial projections 27 on the first axial end 13 of the drive means 3 function as a bayonet coupling whereby the driving means 3 and the mounting bracket 5 are relatively rotated to engage the projections 27 behind the uninterrupted portions of the receiving collar 11, which extend between the successive radial recesses 25. The latch portion 15 can then be swivelled to engage a relevant one of the projections 27 to prevent the drive means 3 to disengage from the mounting bracket 5. The drive means 3 is also seen in FIG. 1 to have a second axial driven end 29 that, in use, drivingly engages an end of a roller tube 31 of a roller blind. A ball chain 33 depends from the drive means 3 to transmit a manual driving force to the driven end 29. The driven end 29 is journaled on a non-rotatable shaft 35.

The drive means 3 will now be described in more detail in reference to FIGS. 2 to 8.

Figure 2:
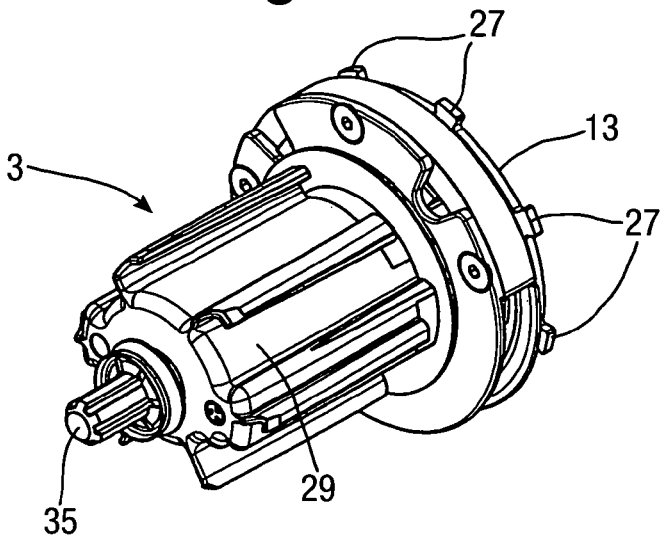
FIG. 2 is a perspective view of the drive means from FIG. 1.

FIG. 2 shows the drive means 3 in the position of FIG. 1 but without the mounting bracket 5, the blind roller 31, and the ball chain 33.

Figure 3:
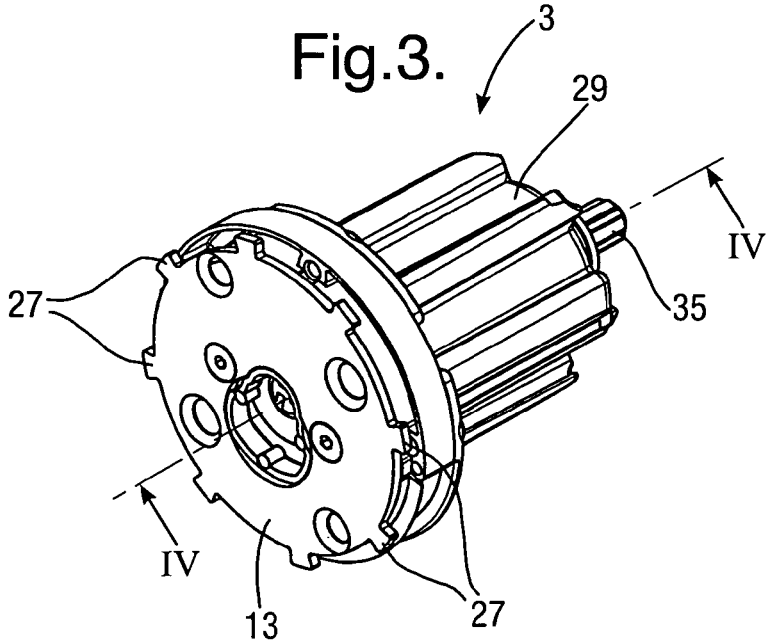
FIG. 3 is a perspective view of the drive means of FIG. 2, viewed from an opposite direction.

FIG. 3 is a view similar to FIG. 2, but viewed from an opposite direction showing the first stationary end 13.

Figure 4:
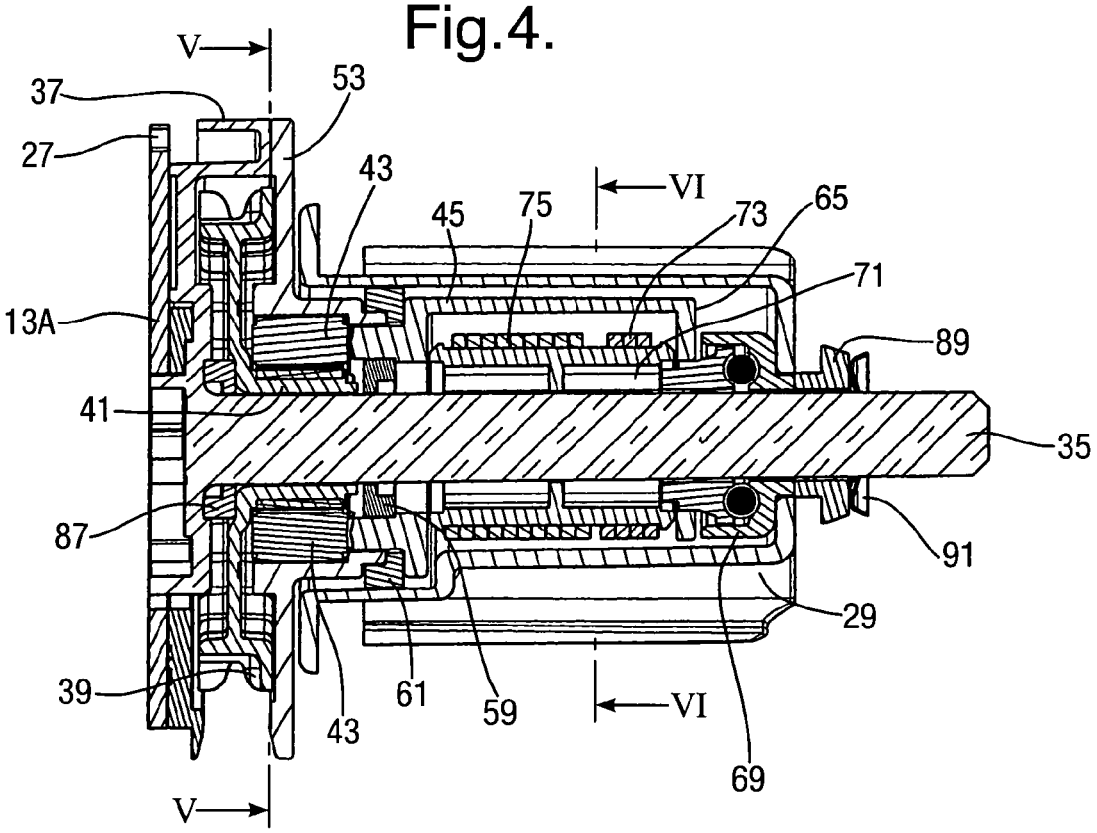
FIG. 4 is a longitudinal cross-section of the drive means along line IV-IV in FIG. 3.
Figure 5:
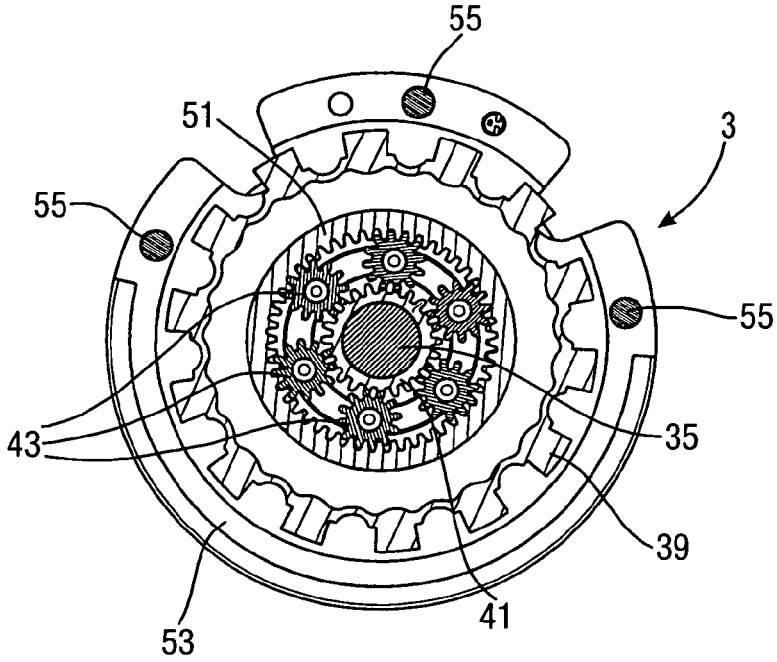
FIG. 5 is a transverse cross-section of the drive means along line V-V in FIG. 4.

FIG. 4 is a cross-section through the drive means 3 of FIG. 3 in the direction of arrows IV-IV. As can be appreciated from the cross-sectional view of FIG. 4, the non-rotatable shaft 35 is conveniently formed integrally on a base member 37. The base member 37 thereby serves as a central backbone and rotatably receives a ball chain pulley 39 which journals on the non-rotatable shaft 35.

Figure 7:
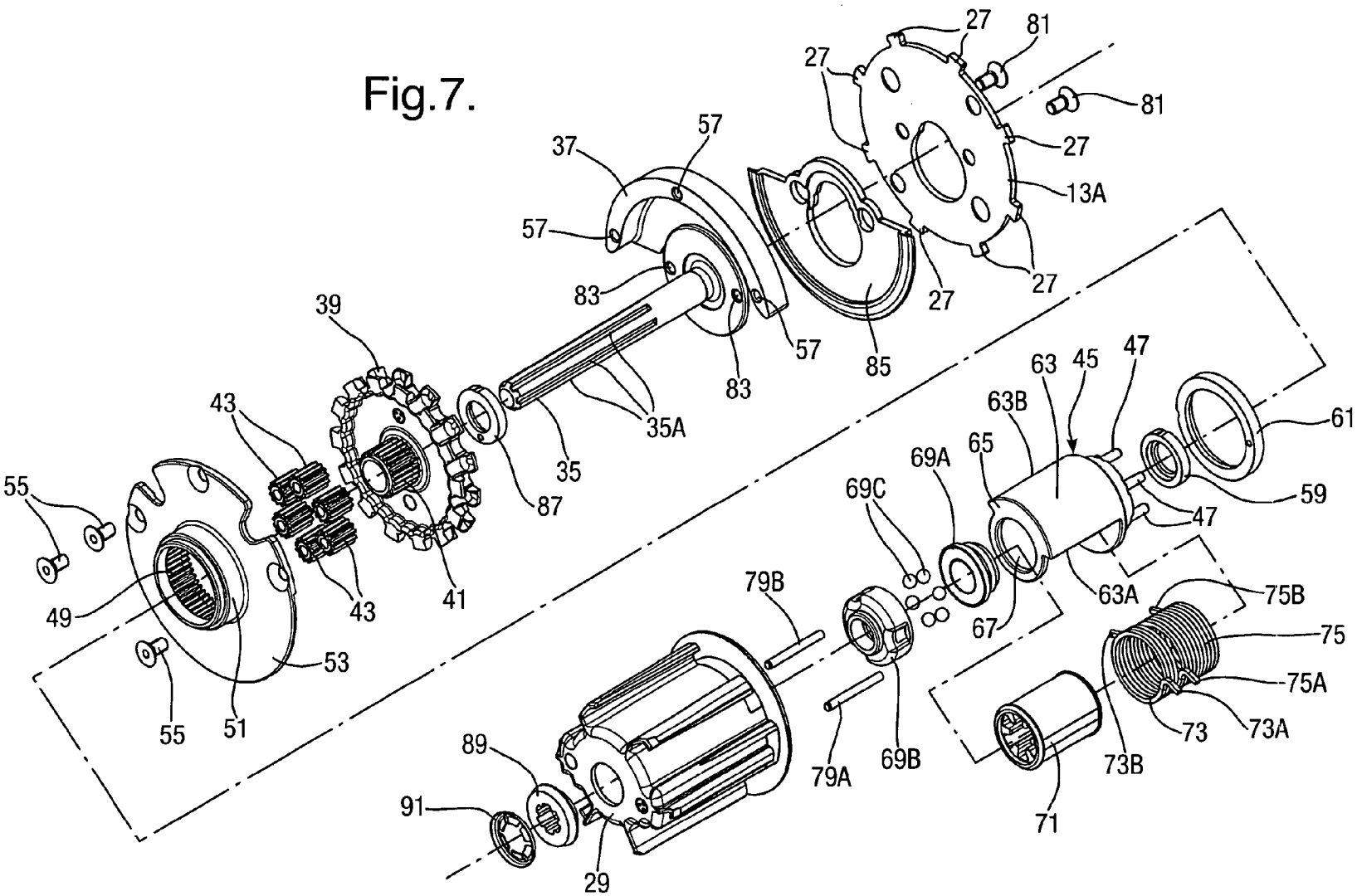
FIG. 7 is an exploded view of the drive means in the position of FIG. 2.
Figure 8:
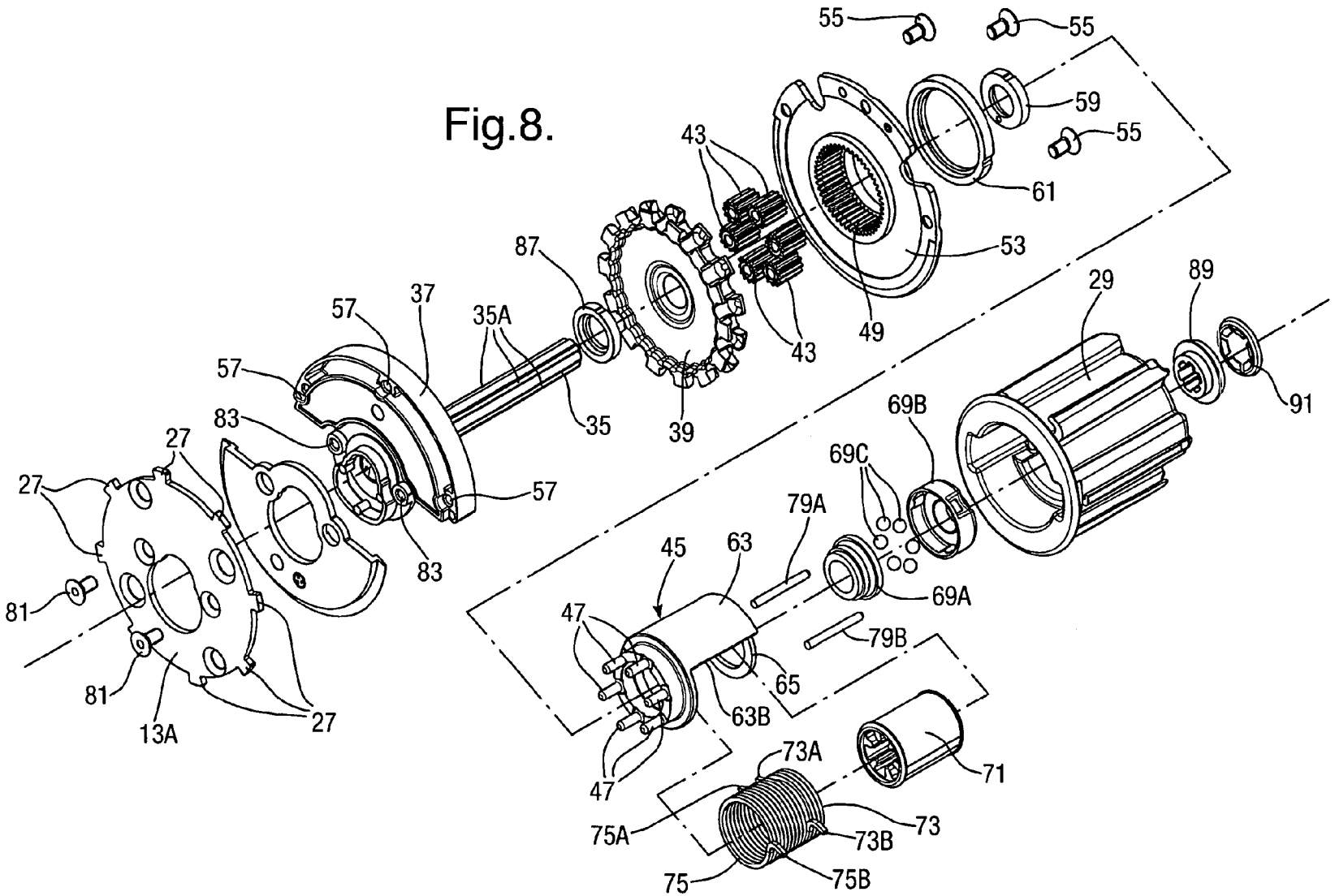
FIG. 8 is an exploded view of the drive means in the opposite position of FIG. 3.

As can be more clearly seen in the exploded views of FIGS. 7 and 8, the ball chain pulley 39 has a central hub 41, which is outwardly toothed to form a sun gear for a plurality of satellite pinions 43. The satellite pinions 43 are rotatably received on a satellite carrier 45 that has a plurality of axially extending pinion shafts 47 for rotatably journaling the satellite pinions 43. A ring gear 49 is provided on a sleeve portion 51 of a lid 53. The lid 53 is non-rotatably attached to the base member 37 by screws 55 for which the base member 37 is provided with screw threaded bores 57. The satellite carrier 45 is journalled on the non-rotatable shaft 35 and the sleeve portion 51 of the lid 53, by inner and outer bearing rings 59, 61 respectively. At its end, axially remote from the axially extending shafts 47, the satellite carrier 45 has a generally semi-cylindrical sleeve portion 63 supported by an end flange 65. The end flange 65 has a central aperture 67 for receiving a combination bearing 69. The combination bearing 69 is composed of a radial plain bearing 69A for engaging the central aperture 67 of the satellite carrier 45 and for bearing on the non-rotatable shaft 35. The combination bearing 69 further has an axial raceway formed between the plain bearing 69A and a thrust bearing compartment 69B between which a plurality of balls 69C are engaged. The use of a ball bearing to support axial bearing loads enables the use of an axial spring bias to retain a blind roller (such as 31, in FIG. 1) between opposite mounting brackets (such as 5, in FIG. 1). Within the semi-cylindrical sleeve portion 63 there is room to accommodate a wrap spring drum 71, which will be non-rotatably engage spines 35A on the non-rotatable shaft 35. Engaged with the outer circumference of the wrap spring drum 71 are first and second wrap springs 73, 75. Each of the first and second wrap springs 73, 75 terminate in radially extending tangs 73A, 73B, 75A and 75B respectively, for a purpose to be described further on. The radially extending tangs 73A and 75A will generally overly a first edge 63A of the semi-cylindrical sleeve portion 63, while the opposite tangs 73B and 75B overly a second edge 63B of the sleeve 63.

Figure 6:
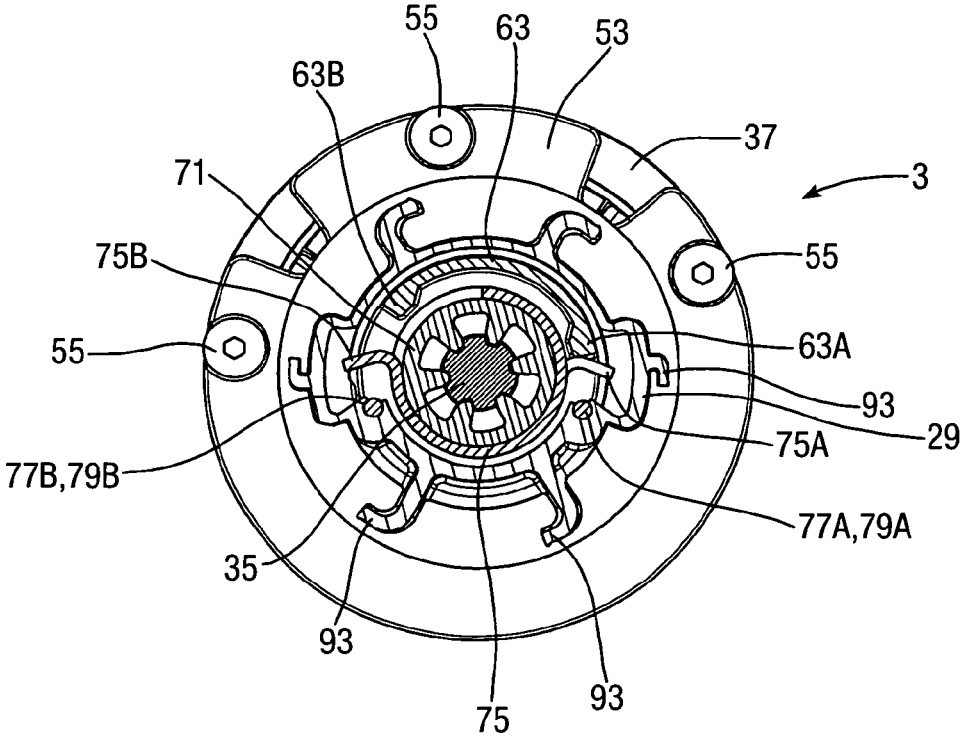
FIG. 6 is another transverse cross-section of the drive means according to line VI-VI in FIG. 4.

As can be seen in FIG. 6, which is a cross section along the line VI-VI in FIG. 4, the driven member 29 of the second end surrounds the semi-cylindrical sleeve portion 63 and first and second wrap springs 73, 75. The driven member 29 further is provided with internal axially extending first and second engagement edges 77A, 77B. The first and second engagement edges 77A, 77B can be reinforced by steel pins 79A, 79B, when the driven member 29 is made from plastics or other relatively soft material. When the satellite carrier 45 is rotated in either one of rotationally opposite directions, the first or second edges 63A, 63B will engage the confronting tangs 73A, 75A or 73B, 75B in a direction that loosens the grip on the wrap spring drum 71. This will allow further rotation of the satellite carrier 45 and its semi-cylindrical sleeve portion 63, in the same direction. Upon such continued rotation of the satellite carrier 45, a relevant one of the first or second engagement edges 77A, 77B will be engaged via the confronting spring tangs and become engaged for rotation with the satellite carrier 45. Any roller blind tube or other window covering element, connected to the driven member 29, will thus be driven when the driven member 29 is rotated by the satellite carrier 45.

Conversely when the satellite carrier 45 is not rotated the weight of a blind member raised by the driven member 29 may exert a rotating force on the driven member 29. Reverse driving of the driven member 29 will be inhibited by either of the engagement edges 77A or 77B engaging its confronting spring tangs 73A, 75A or 73B, 75B. Such inverse engagement will increase the grip of the first and second wrap springs 73, 75 on the wrap spring drum 71 and prevent any rotation to continue in that direction.

It is further seen in FIGS. 7 and 8 that end plate 13A, forming the stationary first axial end, which carries the radial projections 27, is detachably mounted to the base member 37 by means of screws 81 that engage into corresponding threaded bores 83 in the base member 37. Hence, it is possible to easily exchange the end plate 13A against a version having a different configuration if so desired. Between the end plate 13A and the base member 37 an optional guide plate 85 may be provided to guide the ball chain (33 in FIG. 1) onto the ball chain pulley 39 and minimise wear. To this end the optional guide plate 85 may be made of a softer and/or more wear resistant material than the end plate 13A or base member 37.

To reduce friction between the ball chain pulley 39 and the base member 37, a further bearing ring 87 may be provided to take the radial and thrust bearing loads. As further visible in FIGS. 4, 7 and 8, the assembly may be completed and be held together by a thrust washer 89 and a speed nut 91 clamping around the stationary shaft 35. According to an important aspect of the present invention the first wrap spring 73 differs from the second wrap spring 75 in the number of windings and hence the operating force of each wrap spring is different. In the illustrated embodiment the first wrap spring 73 has three full windings, whereas the second wrap spring 75 has nine full wraps. While it has been common practise to use, subject to a required brake force, either single wrap springs of an appropriate size or a variable number of wrap springs of a uniform size for economy and stock keeping. In the case of a roller blind type window covering the required braking force in the raised position is minimal, while in the lowered position it is maximal. Hence the required number of wrap spring windings is determined by the maximum required braking force in the fully lowered position. However with the increase of the number of windings in a wrap spring also the rotational movement between a fully released and a full engaged wrap spring will increase too. This effect results in an amount of backlash from the intended adjusted position to a position in which the blind will be retained. When a wrap spring has a relatively large number of wraps or windings, the effect can become quite noticeable in trying to move the roller blind to its fully raised position. It then happens that a proper raised position cannot be reached, because the bottom edge of the blind material always drops back a certain amount before the wrap spring attains its fully gripping position. Using more than a single wrap spring, each of a uniform size, has brought some improvement, because in the raised position one of the springs, with less than the total number of windings, will by itself be sufficient to determine the raised position and achieve this with less backlash. Nonetheless this beneficial effect would only have been available with blinds of a size requiring the use of more than one uniform wrap spring. Moreover the different engagement angles for the raised and lowered positions were strictly determined by the available individual wrap springs. According to an advantageous aspect of the present invention the maximum required wrap spring force is distributed over the first wrap spring 73, with a number of windings adapted to the required braking force in the fully raised position, and the second wrap spring 75, with an appropriate number of windings adapted to the additionally required braking force in the fully lowered position. Thus the combination of differing first and second wrap springs 73, 75 in the present drive system has eliminated a major concern in the operation of roller blinds. Also dimensional variations in the manufacture of wrap springs have ruled out the making available of strictly identical springs if it comes to the exact position of the radial spring tangs. As such it has also been rather difficult, if not impossible, to obtain simultaneous engagement of all spring tangs when plural wrap springs are used. This has detracted from the smooth operation of such window coverings. It has now also been found that a somewhat awkward effect of sequentially engaging wrap springs of identical operating force can be greatly reduced if there is a significant difference in operating force between such successive wrap springs.

It is further seen in FIGS. 6 to 8 that the driven member 29 on its outer circumference is provided with shaped formations 93, which may be adapted to a respective internal configuration of a blind roller tube (31 in FIG. 1) to obtain a good rotational coupling therewith.

The operation of the drive system of the invention will now be briefly described. With the drive means 3 engaged with the mounting bracket 5 and blind roller 31, as shown in FIG. 1, a manual force applied to the ball chain 33 will rotate the chain pulley 39 in any desired one of two opposite rotational directions. Rotation of chain pulley 39 around the non-rotatable shaft 35 will rotate the toothed central hub 41 which will put the satellite pinions 43 in rolling motion against the stationary ring gear 49 on the lid 53. Via the axial pinion shafts 47 the satellite carrier 45 will thereby be rotated at half speed, but with double the torque of the chain pulley 39. As already described above, this will make the semi-cylindrical sleeve 63 of the satellite carrier 45 to engage the first or the second radial spring tangs 73A, 75A; 73B, 75B in a rotational direction releasing their gripping force from the stationary wrap spring drum 71. Continued rotation in the same direction will see the relevant first or second spring tangs 73A, 75A; 73B, 75B engage the relevant first or second engagement edge 77A, 77B of the driven member 29. The latter will thereby rotate any blind roller (31 in FIG. 1) with which it happens to be engaged.

It is thus believed that the operation and construction of the present invention will be apparent from the foregoing description and accompanying drawing figures. The invention is not limited to any embodiment herein described and, within the purview of the skilled person; modifications are possible which should be considered within the scope of the appended claims. It may, for instance, be noticed that the planetary gear reduction may not be eliminated in drive units for small sized window coverings. When using a planetary, epicyclical type of gearing the reduced speed, and increased torque, drive from the satellite carrier may alternatively also be obtained by the central sun gear being stationary rather than the surrounding ring gear, and the latter being driven. Equally any other kinematical inversions are considered inherently disclosed and to be within the scope of the present invention. The term comprising when used in this description or the appended claims should not be construed in an exclusive or exhaustive sense but rather in an inclusive sense. Expressions such as: "means for . . . " should be read as: "component configured for . . . " or "member constructed to . . . " and should be construed to include equivalents for the structures disclosed. The use of expressions like: "critical", "preferred", "especially preferred" etc. is not intended to limit the invention. Features which are not specifically or explicitly described or claimed may be additionally included in the structure according to the present invention without deviating from its scope.

The invention claimed is:

1. Operating unit for an architectural covering, in particular a roller blind or shade, that exerts a first rotational force in a fully raised position and a second rotational force in a fully lowered position, the operating unit including a stationary base member, a rotatable driving member, a rotatable driven member, and a brake mechanism for automatically arresting rotation of the driven member in respect of the stationary base member when not rotated by the driving member, wherein the brake mechanism includes a first wrap spring and at least one second wrap spring, the first wrap spring having a first number of windings configured to maximally yield a first brake force that amounts to the first rotational force of the architectural covering, the at least one second wrap spring having a different operating force than the first wrap spring, the at least one second wrap spring having a second number of windings greater than the first number of windings and configured to yield a supplementary brake force, which together with the brake force of the first wrap spring amounts to a predetermined maximum brake force, wherein the supplementary brake force is greater than the first brake force.

2. Operating unit according to claim 1, further including a planetary gearing between the driving member and the driven member.

3. Operating unit according to claim 2, wherein the planetary gearing has a satellite carrier adapted to rotate the driven member.

4. Operating unit according to claim 3, wherein the planetary gearing has a sun gear rotated by the driving member, for driving a plurality of satellite pinions on the satellite carrier, and a ring gear kept stationary by the stationary base member.

5. Operating unit according to claim 1, wherein the stationary base member includes a non-rotatable shaft.

6. Operating unit according to claim 5, wherein the non-rotatable shaft is a splined shaft.

7. Operating unit according to claim 6, wherein the non-rotatable splined shaft receives a wrap spring drum.

8. Operating unit according to claim 1, wherein bearings are provided between the driving member and the stationary base member, between the driven member and driving member, and between the driven member and the stationary member.

9. Operating unit according to claim 8, wherein one of the bearings is a thrust bearing.

10. Operating unit according to claim 9, wherein the thrust bearing is a ball bearing.

11. Operating unit according to claim 1, wherein the driving member is a ball chain pulley that is engaged by a looped ball chain drivingly engaging a part of its perimeter.

12. Operating unit according to claim 11, wherein the stationary member has a guide plate to guide the ball chain and to minimise wear between the ball chain and the stationary base member.

13. Operating unit according to claim 1, further including a blind roller tube.

14. Operating unit according to claim 13, wherein the driven member and the roller blind tube have complementary engaging formations to drivingly connect the blind roller tube to the driven element.

15. Operating unit according to claim 1, further including a mounting bracket.

16. Operating unit according to claim 15, wherein the mounting bracket has a first flange and a receiving collar thereon for disconnectedly connecting to the stationary base member.

17. Operating unit according to claim 16, wherein the mounting collar has a plurality of radial recesses and the stationary base member has an end plate with a corresponding plurality of radial projections.

18. Operating unit according to claim 17, wherein the mounting collar and the end plate are relatively movable from a first position in which the projections can be inserted and released from the recesses into a second position in which the projections are engaged behind uninterrupted portions of the receiving collar that extend between successive radial recesses.

19. Operating unit according to claim 18, wherein the receiving collar has a latch formation for locking the end plate and the receiving collar in the second position.

20. Operating unit according to claim 1, wherein the maximum brake force corresponds to the second rotational force of the architectural covering to keep the architectural covering in its fully lowered position.

21. Operating unit according to claim 1, wherein the second number of windings is triple the first number of windings.

22. An operating unit for an architectural covering that has a rotational force when in a fully raised position, the operating unit comprising:

a stationary base member;

a driven member rotatable relative to the stationary base member in a first direction and a second direction opposite the first direction;

a driving member configured to rotate the driven member in the first direction; and a brake mechanism configured to inhibit rotation of the driven member in the second direction, the brake mechanism including:

a first wrap spring having a number of windings configured to maximally yield a first operating force that amounts to the rotational force of the architectural covering in the fully raised position; and a second wrap spring having a different operating force and a greater number of windings than the first wrap spring; the second wrap spring configured to yield a supplementary operating force, which together with the first operating force of the first wrap spring amounts to a predetermined maximum operating force, wherein the supplementary operating force is greater than the first operating force.

* * * * *